US006132018A

United States Patent [19]

McGrath

[11] Patent Number: 6,132,018

[45] Date of Patent: Oct. 17, 2000

[54] ADJUSTABLE SNEEZEGUARD APPARATUS

[75] Inventor: Andrew H. McGrath, 1509 Ortega Dr., Martinez, Calif. 94553

[73] Assignees: Andrew H. McGrath; David Murry, both of Concord, Calif.

[21] Appl. No.: 09/265,713

[22] Filed: Mar. 9, 1999

[51] Int. Cl.[7] ..... A47F 9/00

[52] U.S. Cl. ..... 312/140.4; 248/398; 248/515

[58] Field of Search ..... 108/27, 150, 49, 108/4, 6, 9, 148, 96; 312/140.1, 140.3, 140.4, 137; 248/515, 398, 454

[56] References Cited

U.S. PATENT DOCUMENTS

| | | | |
|---|---|---|---|
| 874,435 | 12/1907 | Prescott | 248/398 |
| 2,567,593 | 9/1951 | Bemis | 108/4 |
| 3,073,660 | 1/1963 | Schultz | 108/150 |
| 3,543,312 | 12/1970 | Pofferi | 108/49 |
| 4,892,366 | 1/1990 | Yerman | 312/140.4 |
| 5,082,334 | 1/1992 | Beyer et al. | 312/140.4 |
| 5,584,545 | 12/1996 | LaVaute et al. | 312/140.4 |
| 5,823,102 | 10/1998 | Will | 312/140.4 |

*Primary Examiner*—Peter M. Cuomo
*Assistant Examiner*—Jerry A. Anderson
*Attorney, Agent, or Firm*—Thomas R. Lampe

[57] ABSTRACT

Adjustable sneezeguard apparatus includes a double-ended, elongated support member which is pivotal relative to a support. A sneezeguard panel holder is connected to the elongated support member and is pivotal relative to the support member.

17 Claims, 8 Drawing Sheets

ADJUSTABLE SNEEZEGUARD APPARATUS

TECHNICAL FIELD

This invention relates to sneezeguards, devices which are employed to shield foods or other materials. Such devices are typically, but not exclusively, employed in restaurants, cafeterias and the like.

BACKGROUND OF THE INVENTION

Sneezeguards typically are fixedly mounted at locations of use and include elongated bars or support members fixedly mounted in place and fixedly holding a sneezeguard panel formed of glass or the like at a set orientation and height. Since such prior art devices are not adjustable they must be essentially custom made to fit in with a specific environment and conform to the local health laws or codes pertaining thereto.

It is important that sneezeguard devices be constructed in such a manner as to present minimal cracks, gaps and the like in the construction thereof which act as repositories for food or other materials which could cause contamination and rigid, permanent installations of the type referenced above are constructed as to satisfy this requirement.

DISCLOSURE OF INVENTION

The present invention relates to sneezeguard apparatus which is adjustable in nature and which can readily be employed in a variety of installation environments while still satisfying the requirements of applicable codes. Furthermore, the sneezeguard apparatus disclosed and claimed herein has been fashioned in such a manner as to minimize the possibility of food or other materials lodging between the parts thereof. The apparatus is further characterized by its relative simplicity and ease of installation. The adjustability feature of the apparatus means that less "customizing" is required for a given installation, thus leading to cost savings.

The sneezeguard apparatus includes mounting means for mounting the sneezeguard apparatus on a support and a double-ended, elongated support member.

Adjustable connector means is disposed at one of the ends of the elongated support member adjustably connecting the elongated support member to the mounting means and allowing pivotal movement of the elongated support member relative to the mounting means whereby the elongated support member may be selectively, alternatively positioned in a plurality of angular orientations relative to a support.

The apparatus further includes a sneezeguard panel holder connected to the elongated support member at a location spaced from the mounting means for holding a sneezeguard panel.

The sneezeguard panel is located at the other or distal end of the elongated support and the apparatus additionally comprises a connector adjustably, pivotally connecting the sneezeguard panel to the elongated support member and allowing pivotal movement of the sneezeguard panel holder and any sneezeguard panel held thereby relative to the elongated support member whereby the sneezeguard panel holder and any sneezeguard panel held thereby may be selectively alternatively positioned in a plurality of angular positions relative to the elongated support member.

Other features, advantages, and objects of the present invention will become apparent with reference to the following description and accompanying drawings.

MODES FOR CARRYING OUT THE INVENTION

Figure 1:
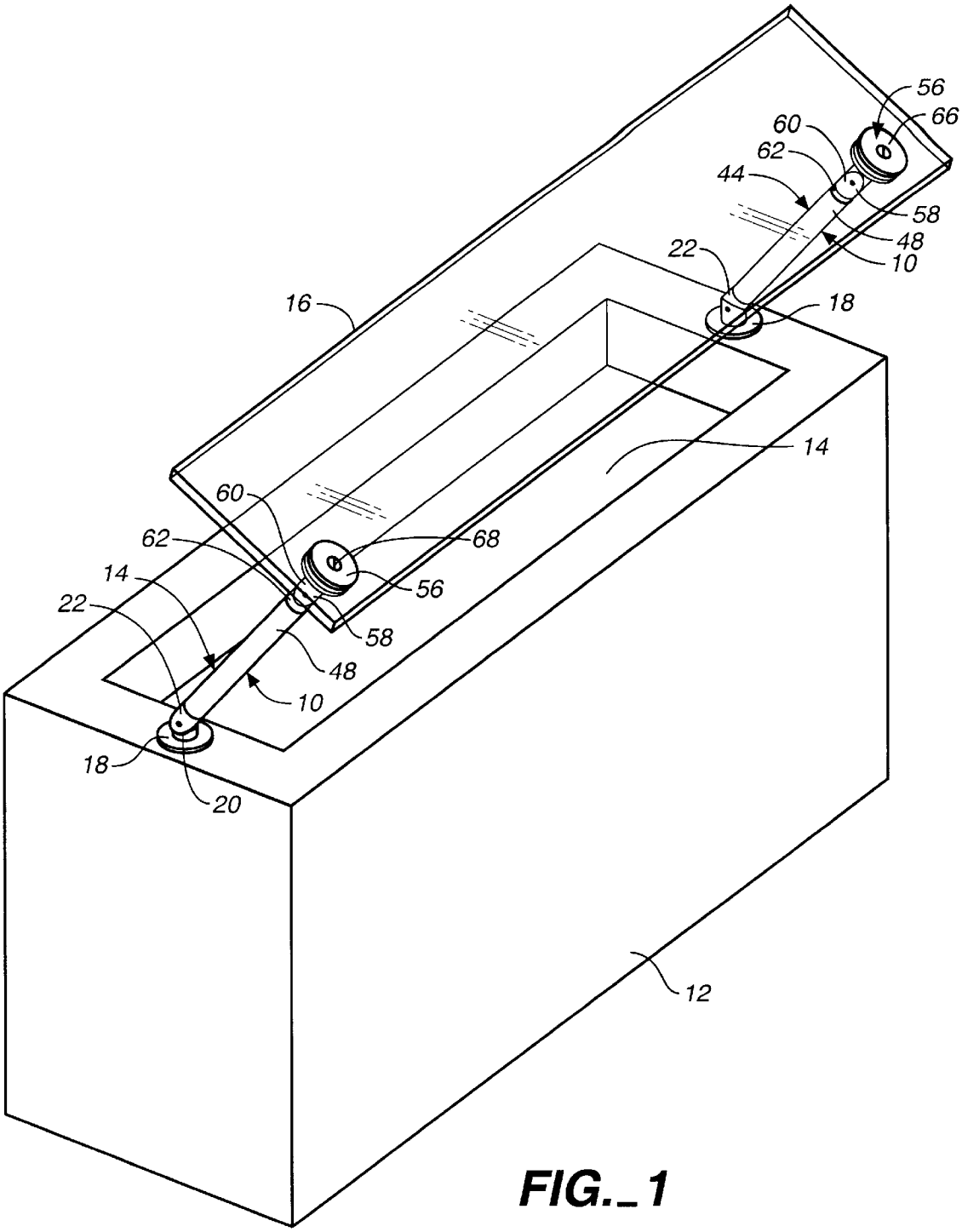
FIG. 1 illustrates apparatus constructed in accordance with the teachings of the present invention being utilized to support a sneezeguard panel relative to a typical salad bar layout.
Figure 2:
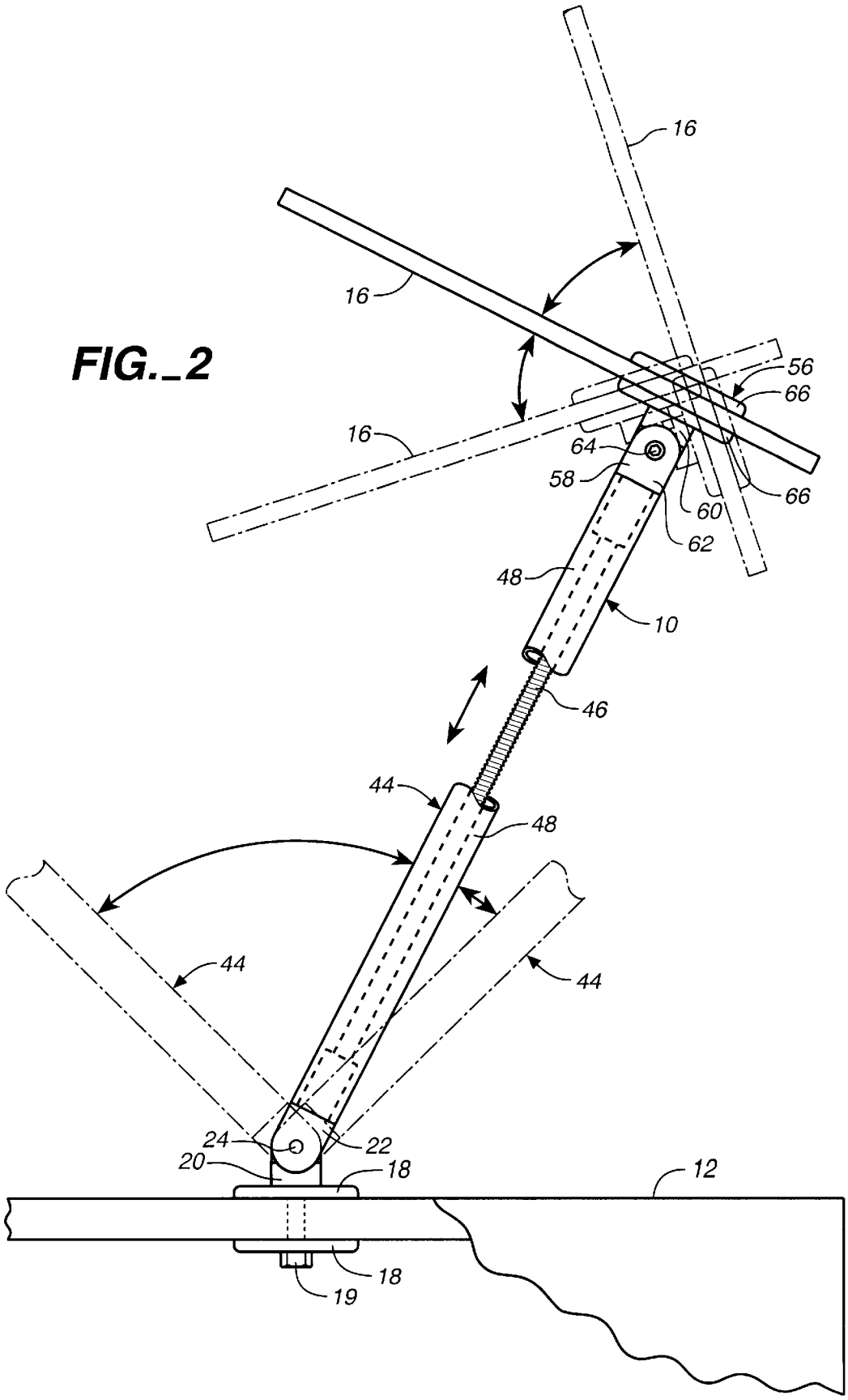
FIG. 2 is an enlarged side view illustrating the apparatus, with portions thereof broken away, deployed in alternative positions and orientations, solid and phantom lines being employed to depict same.
Figure 3A:
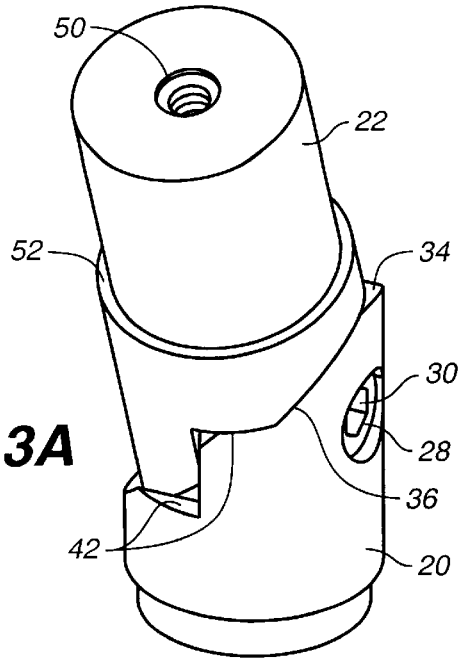
FIG. 3A is a greatly enlarged perspective view illustrating assembled adjustable connector means employed in the apparatus.
Figure 3C:
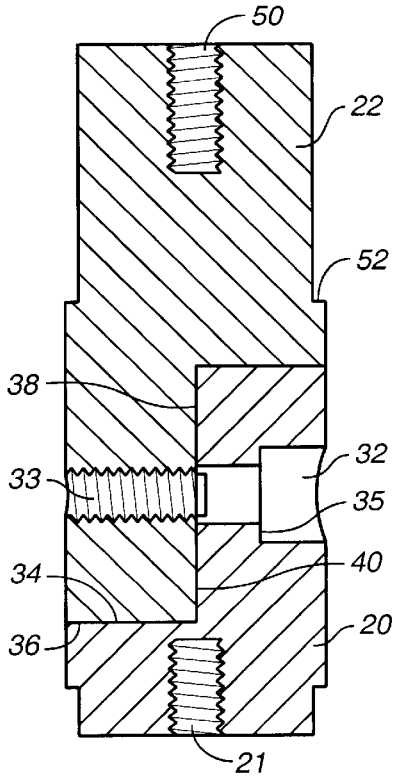
FIG. 3C is an elevational cross-sectional view of the adjustable connector means.
Figure 3B:
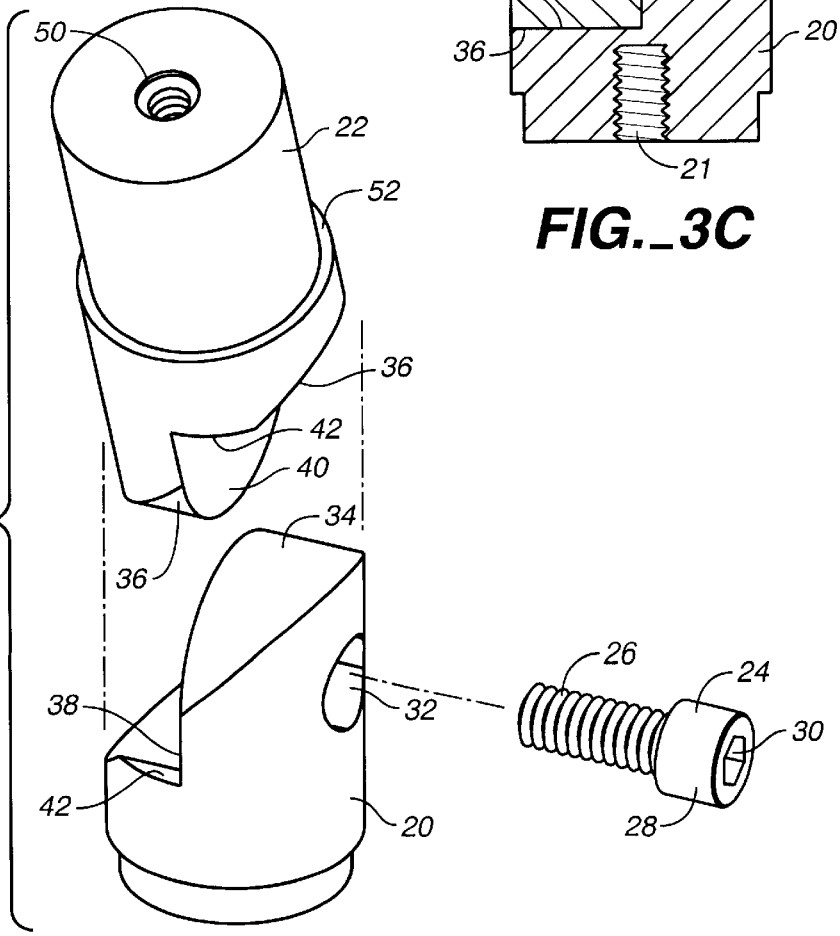
FIG. 3B is an exploded view of the adjustable connector means.
Figure 4:
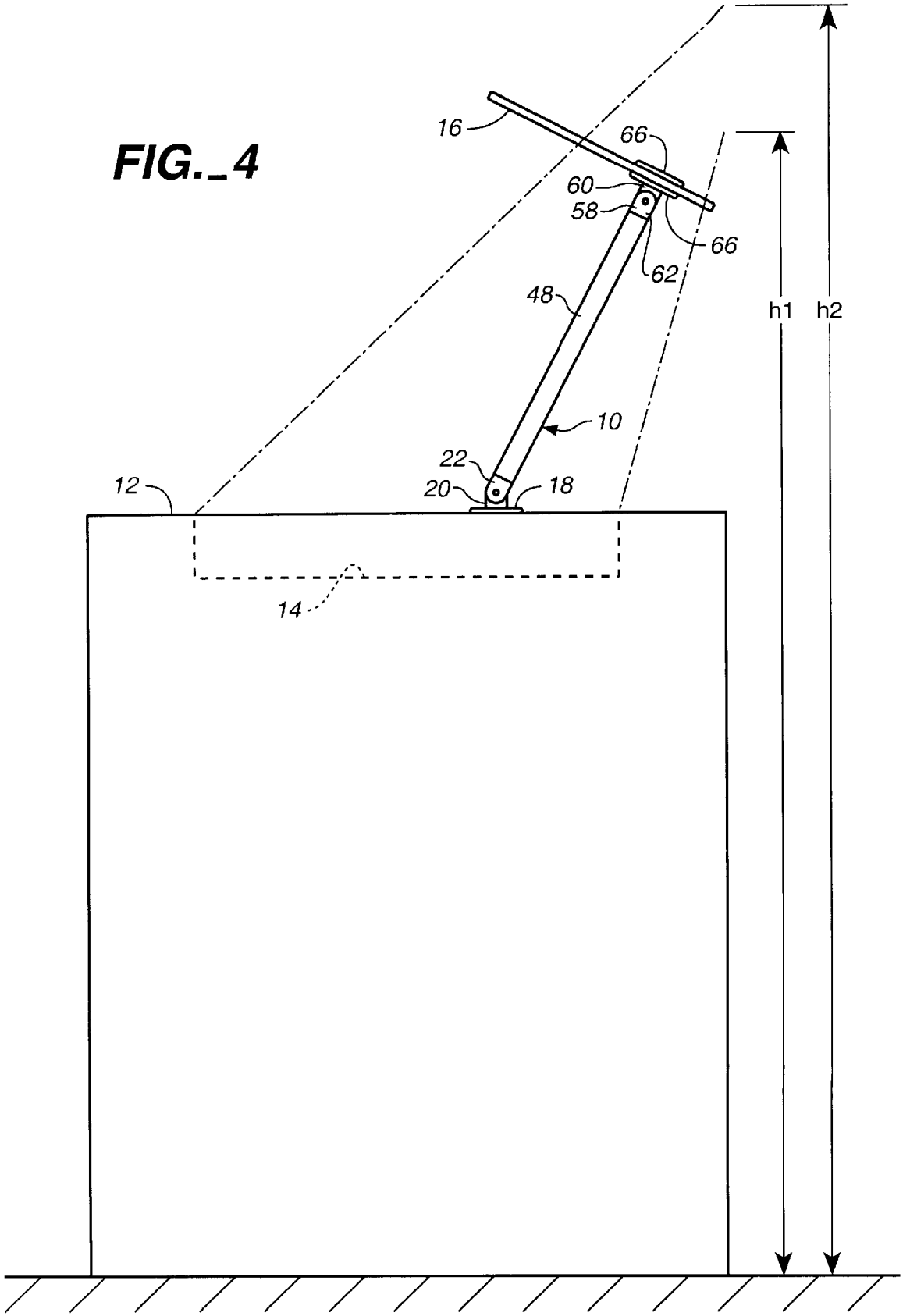
FIG. 4 is a schematic side elevational view illustrating the apparatus positioned on a salad bar cabinet and maintaining a sneezeguard panel at a desired location.

Referring now to FIGS. 1–4, sneezeguard apparatus constructed in accordance with the teachings of the present invention is illustrated and designated by reference numeral 10. In FIGS. 1, 2 and 4, the apparatus 10 is disclosed as being attached to the top of a salad bar cabinet 12 having a receptacle 14 for the food product (not shown) being displayed and available for access by the consumer. FIG. 1 discloses two identical embodiments of the apparatus being employed to hold a sneezeguard panel 16 formed of glass or other suitable clear material such as plastic.

The sneezeguard apparatus includes mounting means for mounting the sneezeguard apparatus on a support, in this instance the support being the salad bar cabinet per se. The mounting means includes two mounting members 18 which are secured on opposed sides of the salad bar cabinet framework by a bolt 19 (FIG. 2) which extends through the lowermost mounting member 18, and the salad bar cabinet framework.

Adjustable connector means is operatively associated with the mounting means. The adjustable connector means includes a first connector member 20 having a threaded opening 21 threadedly engaged by bolt 19. Bolt 19 rigidly connects the uppermost mounting member 18 to first connector member 20. A second connector member 22 is pivotally movable in a vertical plane relative to the first connector member. More particularly, the connector member 22 is threadedly engaged with a pivot shaft 24 having a threaded end 26 and an enlarged end 28 which has a cylindrically shaped outer surface. A socket 30 is formed in enlarged end 28 so that the pivot shaft 24 may be turned by a suitable tool. The threaded end of the pivot shaft passes through an aperture 32 formed in connector member 20 and fits into a threaded opening 33 in connector member 22. Aperture 32 is restricted in size within the interior of connector member 20 so that enlarged head or end 28 of the pivot shaft cannot pass through connector member 20 but rather bears against interior structure or ledge 35 of the connector member 20 when tightened to draw together the connector member 20 and the connector member 22 into tight engagement. When the connector members are in tight engagement, relative pivotal movement therebetween will be prevented.

Connector member 20 has a curved bearing surface 34 which engages a similarly curved bearing surface 36 on connector member 22 when the connector members are joined together by pivot shaft 24. The bearing surfaces are curved and coaxial with the primary axis of the pivot shaft. In addition, connector member 20 has a planar stabilizer surface 38 adjacent to and extending from the curved bearing surface thereof. Likewise, connector member 22 has a planar stabilizer surface 40. The stabilizer surfaces of the connector members are in engagement and located in a plane orthogonal to the primary axis of the pivot shaft 24 when the pivot shaft secures the connector members together to prevent relative pivotal movement therebetween. Abutment surfaces 42 are formed on the connector members to limit the degree of relative pivotal movement between the connector members.

The apparatus additionally includes a double-ended, elongated support member 44 which is secured to connector member 22.

More particularly, the elongated support member 44 includes an inner threaded shaft 46 (FIG. 2) and an outer tubular member 48. Threaded shaft 46 is threaded into a threaded opening 50 formed in connector member 22. The end of the connector member 22 defining opening 50 is reduced in diameter so that a circular-shaped abutment surface 52 is provided. An end of the tubular member 48 is positioned over the reduced end portion of the connector member 22 and placed in abutting engagement with surface 52.

Positioned at the other end of elongated support member 44 (the upper end as shown in FIGS. 1, 2 and 4) is a sneezeguard panel holder 56. Holder 56 is secured to the end of elongated support member 44 by a connector 58 which may suitably be identical or substantially identical in construction to the above described adjustable connector means. That is, connector 58 includes a connector portion 60 corresponding to the construction of connector member 20 and a connector portion 62 corresponding to connector member 22.

Threaded shaft 46 is threadedly secured to connector portion 62 and the upper end of outer tubular member 48 bears against a circular surface (not shown) on connector portion 62 corresponding to the abutment surface 52 of connector member 22 located at the lower end of the outer tubular member. A pivot shaft 64 in the nature of above-described pivot shaft 24 interconnects cooperates with connector portions 60, 62 as pivot shaft 24 cooperates with connector members 20, 22. It will be appreciated that rotation of either connector member 22 or connector portion 62 about the threaded shaft 46 will cause same to either move toward or away from one another. This action is represented by the double-headed arrow shown parallel to threaded shaft 46 in FIG. 2. This allows the effective length of elongated support member 44 to be varied by inserting different lengths of the outer tubular member in the assembly.

Sneezeguard panel holder 56 includes a pair of clamp members 66 disposed on opposed sides of sneezeguard panel 16. These clamp members have a disc-like configuration and have flat sneezeguard panel engagement surfaces. A threaded bolt or screw 68 passes through central openings (not shown) formed in clamp members 66 and a corresponding hole or opening (not shown) in the sneezeguard panel 16. The threaded connector 68 then is threadedly connected to connector portion 60 and the sneezeguard panel will be clamped into position and fixed relative to connector portion 60 when the threaded connector 68 is tightened.

FIG. 2 illustrates how the angle of inclination of elongated support member 44 relative to mounting members 18 can be varied by loosening pivot shaft 24. Tightening pivot shaft 24 will fix the elongated support member at any preselected angular inclination. Likewise, sneezeguard panel holder 56 and sneezeguard panel 16 may be moved to any desired degree of inclination relative to the elongated support member 44 by loosening pivot shaft 64. Tightening of pivot shaft 64 will maintain the sneezeguard panel holder and sneezeguard in the desired position due to frictional engagement between the connector portions 60, 62.

Many jurisdictions have codes or laws which dictate placement of sneezeguards in restaurants and other facilities where food is served. FIG. 4, for example, illustrates a situation wherein the sneezeguard panel 16 must be positioned between a height range extending between h1 and h2 and a food receptacle 14. That is, the sneezeguard panel must fall within an area which will cause the sneezeguard panel to intercept any matter expelled from a person's face, for example, droplets from a sneeze. The location of the sneezeguard panel dictated by a code can vary considerably from jurisdiction to jurisdiction as can the dimensions of the food area it is designed to protect. Furthermore, there may be practical restrictions as to how and where the sneezeguard apparatus is mounted.

Figure 5:
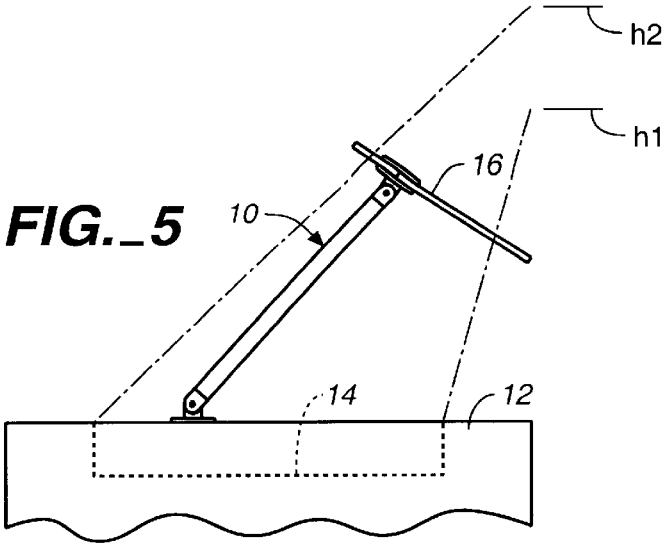
FIG. 5 is a side elevational view illustrating an alternative configuration wherein the sneezeguard panel is positioned forwardly of the apparatus to a greater extent than in the arrangement shown in FIG. 4.
Figure 6:
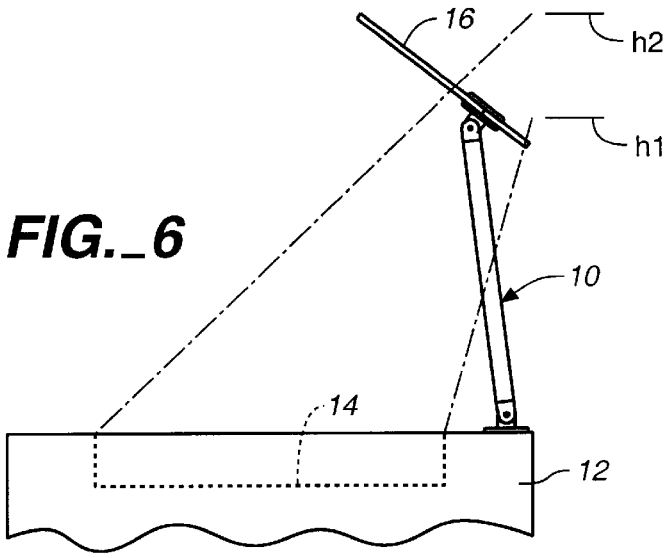
FIGS. 6, 7, 8, 9 and 10 are side elevational views illustrating alternate supports being utilized to support apparatus constructed in accordance with the teachings of the present invention relative to a salad bar or other food station.
Figure 7:
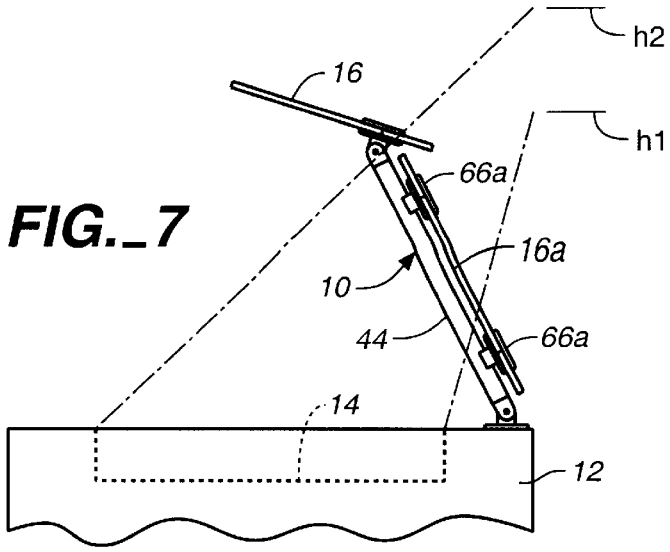

FIGS. 5 and 6, for example, show alternate placement of the apparatus 10 and associated sneezeguard relative to a salad bar receptacle 14. FIG. 7 illustrates the apparatus utilized to support a second sneezeguard panel 16*a* extending along the length thereof by clamp members 66*a* secured to elongated support member 44.

Figure 8:
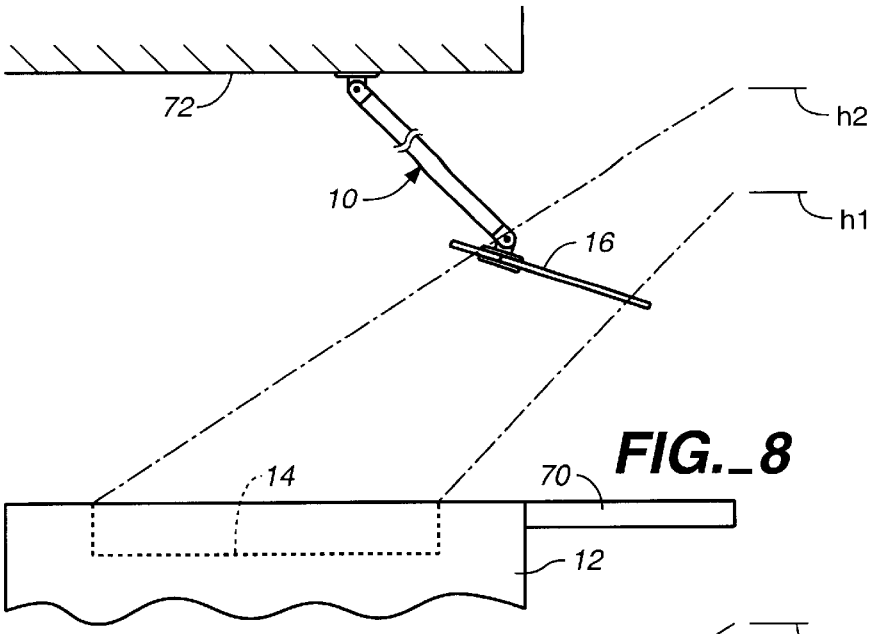
Figure 9:
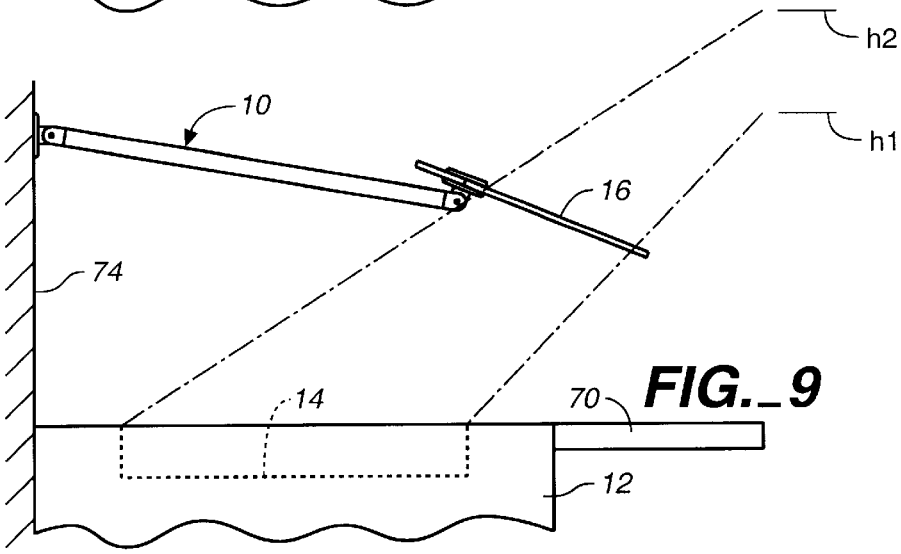

FIGS. 8 and 9 illustrate the apparatus 10 in other operating environments wherein a counter 70 is affixed to a salad bar or other food cabinet. In FIG. 8 the apparatus is mounted on a support in the form of an overhang or ceiling 72 and in FIG. 9 the support is a wall 74.

Figure 10:
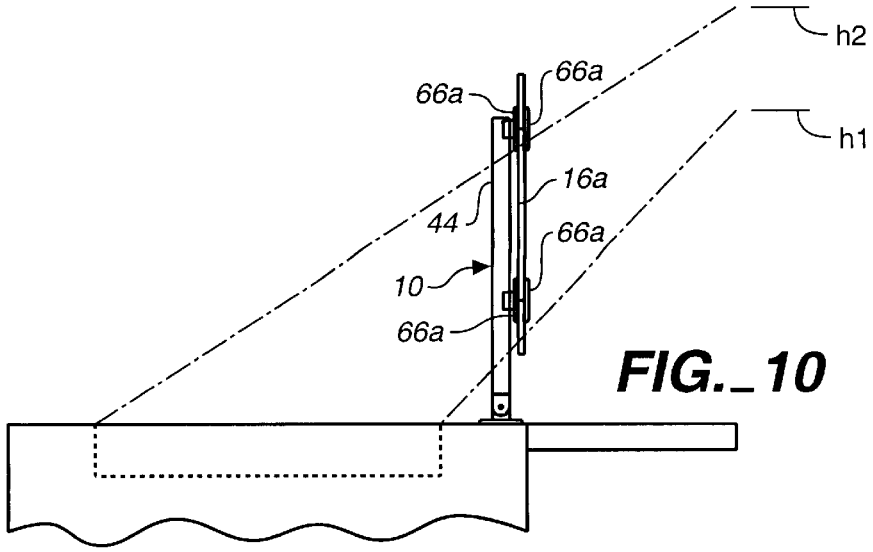

In the embodiment of FIG. 10 a sneezeguard panel 16*a* is secured to and extends along the length of the elongated support member 44 by clamp members 66*a;* that is, there is no tiltable or pivotal sneezeguard panel holder at the distal end of elongated support member 44 employed in this embodiment.

Although the friction between the planar stabilizer surfaces 38, 40 of the connector members 20, 22 and the corresponding planar stabilizer surfaces of connector portions 60, 62 can be utilized to maintain the elongated support member 44 and sneezeguard panel holder 56 at the desired orientations, it is desirable to provide lock means which positively locks these structural elements against relative pivotal movement after the desired degree of inclination or positioning has been attained.

Figure 11:
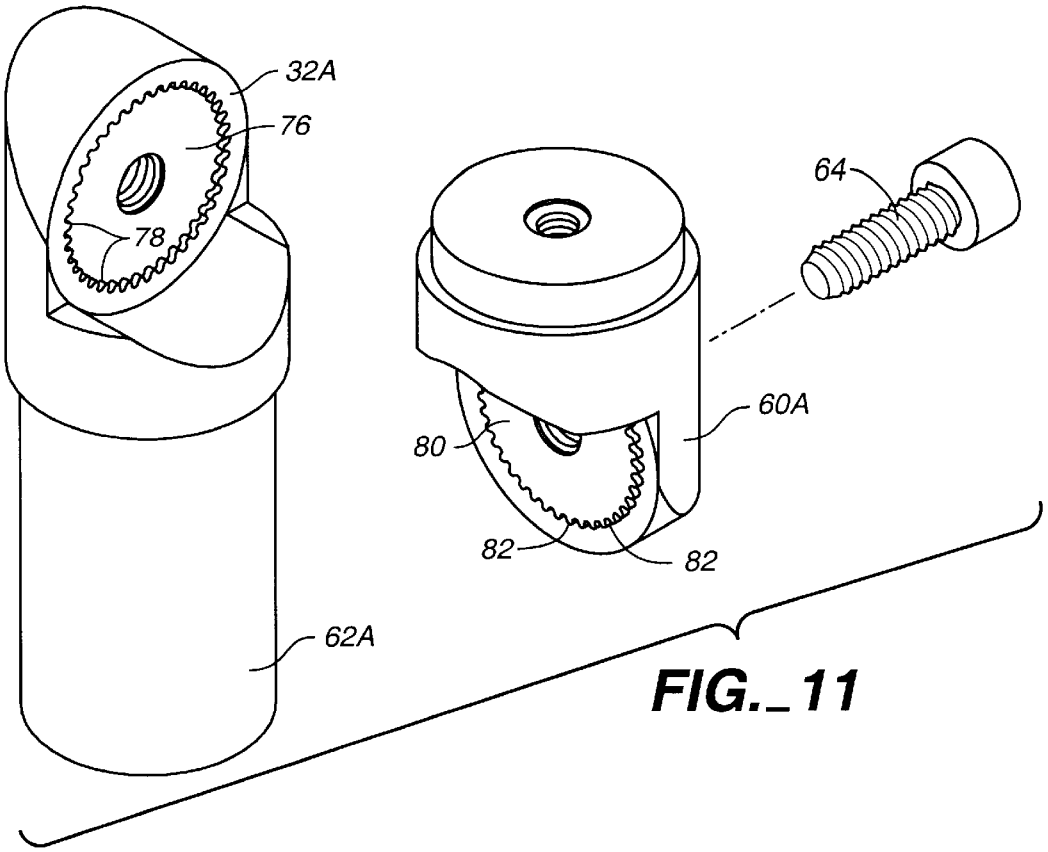
FIG. 11 is an enlarged, exploded, perspective view illustrating the components of an alternative form of adjustable connector means employed in the apparatus incorporating a lock.

FIG. 11 illustrates a connector portion 60A and connector portion 62A which incorporate such a lock. More particularly, the planar stabilizing surface 32A of connector portion 62A has a recess 76 formed therein which is defined about the outer periphery thereof by spaced inwardly directed teeth 78 forming indents and detents. Connector portion 60A is raised at the center thereof to form a generally circular shaped projection 80 having teeth 82 about the periphery thereof. It will be appreciated that the pivot shaft 64 may be utilized to secure the connector portions 60, 62 together at any desired angular orientation, with the teeth 78, 82 of the connector portions locking them against relative pivotal movement.

Figure 12:
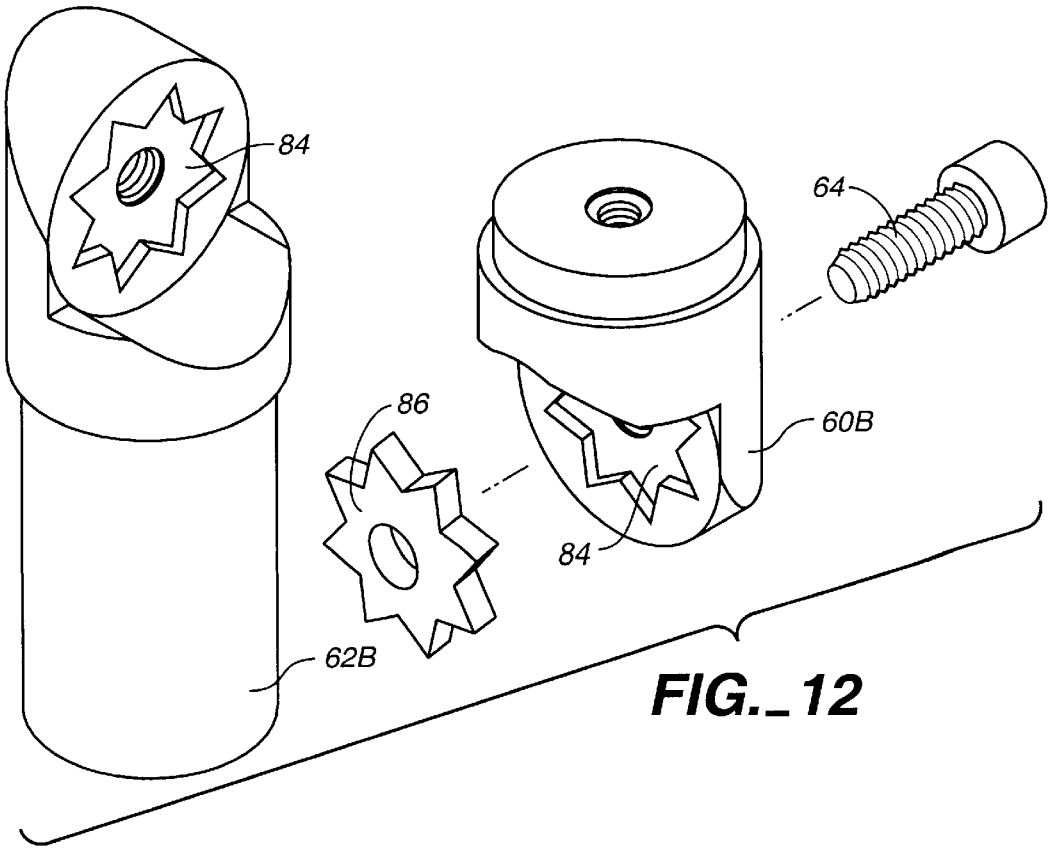
FIG. 12 is a view similar to FIG. 11 but illustrating yet another alternate form of adjustable connector means with lock.

FIG. 12 illustrates another form of lock employed to lock connector portions 60B, 62B against relative rotation. Each of the connector portions has a star-shaped recess 84 formed therein at the stabilizer surfaces thereof. A separate removable lock member 86 having a thickness approximating the combined depths of recesses 84 is positioned therein and held in place by pivot shaft 64 to prevent relative pivotal movement between the connector portions 60B, 62B.

Figure 13:
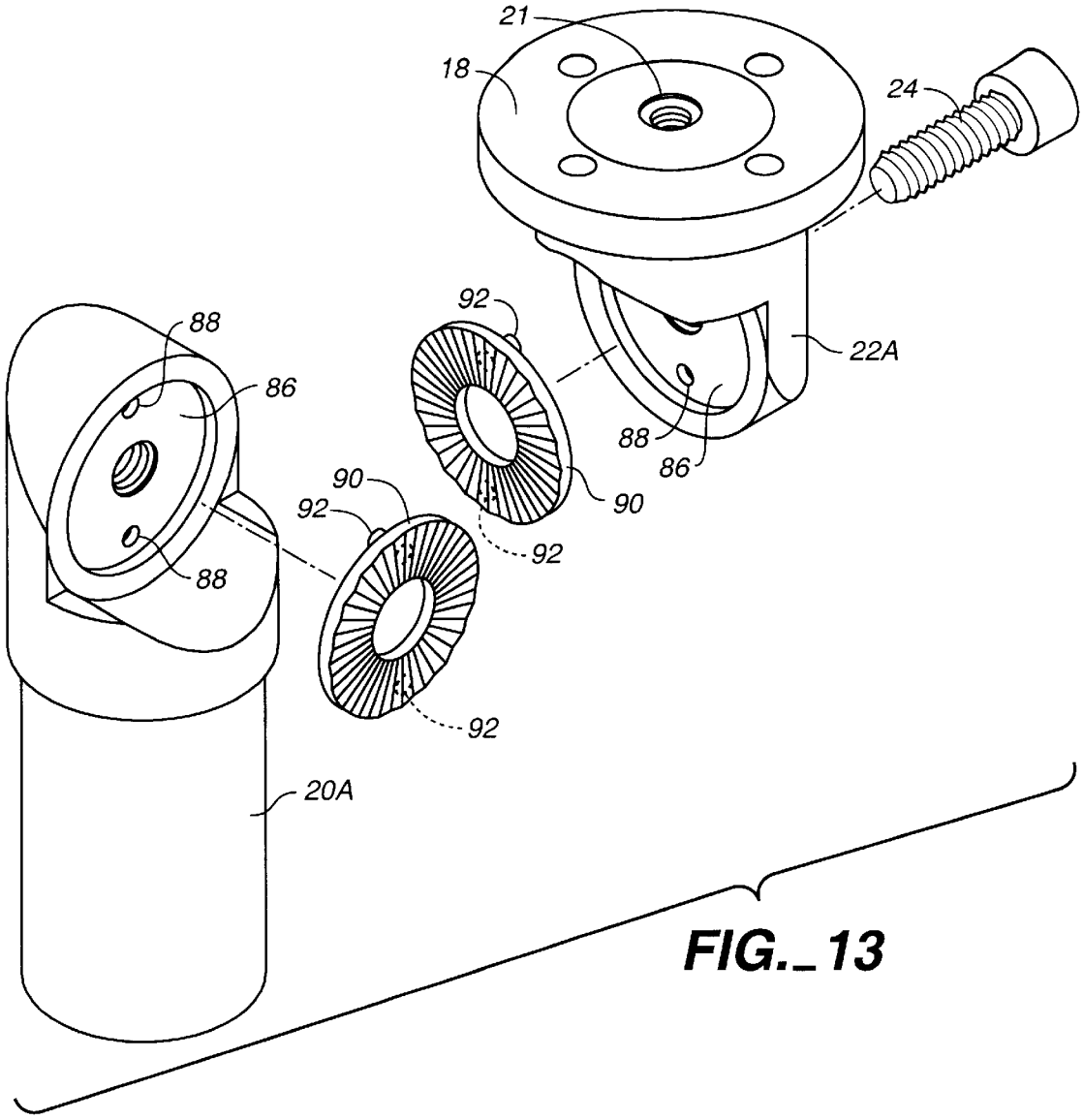
FIG. 13 is an enlarged perspective view of still another alternative connector and lock assembly.

FIG. 13 shows an alternative embodiment of the connector members. Connector member 20A and connector member 22A each have circular recesses 86 formed at the planar stabilizer surfaces thereof. Apertures 88 communicate with the recesses. Discs 90 having pins 92 on one side thereof and radial undulations forming indents and detents on the other side thereof are placed in the recesses so that the pins 92 enter apertures 88 to prevent rotation of the discs relative to their respective connector members. Pivot shaft 24 is then employed to tighten the connector members together. The indents and detents of the discs matingly engage to prevent relative rotation of the connector members.

It will be appreciated that the lock arrangements shown in FIGS. 11–13 can be utilized in association with either (or both) the connector members or connector portions of the invention.

What is claimed is:

1. Sneezeguard apparatus comprising, in combination:

mounting means for mounting said sneezeguard apparatus on a support;

an elongated support member having two spaced ends;

adjustable connector means disposed at one of the ends of said elongated support member adjustably connecting said elongated support member to said mounting means and allowing pivotal movement of said elongated support member relative to said mounting means whereby said elongated support member may be selectively alternatively positioned in a plurality of angular orientations relative to a support;

a sneezeguard panel holder connected to said elongated support member at the other of said ends of said elongated support member for holding a sneezeguard panel;

a connector adjustably, pivotally connecting said sneezeguard panel holder to said elongated support member and allowing pivotal movement of said sneezeguard panel holder relative to said elongated support member, said sneezeguard panel holder being selectively alternatively positionable in a plurality of angular positions relative to said elongated support member, said adjustable connector means selectively alternatively retaining said elongated support member against movement relative to said mounting means in each of said plurality of angular orientations, and said connector selectively alternatively retaining said sneezeguard panel holder against movement relative to said elongated support member in each of said plurality of angular positions, said elongated support member including an inner shaft threaded at least partially along the length thereof and a double-ended outer tubular member surrounding said inner shaft, said inner shaft being threadedly engaged with at least one of said adjustable connector means and said connector whereby relative rotation between said adjustable connector means and said connector on said inner shaft will vary the distance between said adjustable connector means and said connector, said outer tubular member being in abutting frictional engagement with and surrounding portions of said adjustable connector means and said connector at opposed ends of said outer tubular member when the distance between said adjustable connector means and said connector is at a predetermined value and said outer tubular member being disengageable from said adjustable connector means and said connector when said distance exceeds said predetermined value.

2. The sneezeguard apparatus according to claim 1 wherein said connector includes locking means for selectively alternatively positively locking said sneezeguard panel holder against movement relative to said elongated support member in each of said plurality of angular positions.

3. The sneezeguard apparatus according to claim 2 wherein said connector includes pivotally interconnected first and second connector portions and wherein said locking means includes lock elements operatively associated with said connector portions, said lock elements having indents and detents cooperable to lock said first and second connector portions against relative pivotal movement.

4. The sneezeguard apparatus according to claim 3 wherein at least one of said lock elements is releasably connected to a connector portion.

5. The sneezeguard apparatus according to claim 1 wherein said adjustable connector means includes lock means for selectively alternatively positively locking said elongated support member against movement relative to said mounting means in each of said plurality of angular orientations.

6. The sneezeguard apparatus according to claim 1 wherein said elongated support member is pivotally movable relative to said mounting means and said panel holder means is pivotally movable relative to said elongated support member about pivot axes disposed in a common plane.

7. The sneezeguard apparatus according to claim 1 wherein said adjustable connector means comprises a first connector member for rigid attachment to said mounting means at said support, a second connector member, and a pivot shaft pivotally interconnecting said first and second connector members.

8. The sneezeguard apparatus according to claim 7 wherein each of said first and second connector members includes a bearing surface, the bearing surfaces of said first and second connector members being in engagement to provide support for said elongated support member.

9. The sneezeguard apparatus according to claim 8 wherein said pivot shaft has a primary axis and wherein said bearing surfaces are curved and coaxial with the primary axis of said pivot shaft.

10. The sneezeguard apparatus according to claim 9 wherein each of said first and second connector members includes a substantially planar stabilizer surface adjacent to and extending from the curved bearing surface thereof, the stabilizer surfaces of said first and second connector members being in engagement and located in a plane substantially orthogonal to the primary axis of said pivot shaft.

11. The sneezeguard apparatus according to claim 7 wherein said first and second connector members include cooperable abutment surfaces for limiting relative pivotal movement between said first and second connector members.

12. The sneezeguard apparatus according to claim 1 wherein said sneezeguard panel holder includes a pair of clamp members positionable on opposed sides of a sneezeguard panel to clamp the sneezeguard panel therebetween, said clamp members having flat sneezeguard panel engagement surfaces.

13. The sneezeguard apparatus according to claim 12 wherein both said clamp members are attached to said connector.

14. The sneezeguard apparatus according to claim 1 wherein both said adjustable connector means and said connector are threadedly engaged with said inner shaft.

15. The sneezeguard apparatus according to claim 7 wherein said connector means additionally includes lock means for locking said first and second connector members against relative pivotal movement about said pivot shaft.

16. The sneezeguard apparatus according to claim 15 wherein said lock means includes lock members operatively associated with said first and second connector members, said lock members having indents and detents cooperable to lock said first and second connector members against relative pivotal movement.

17. The sneezeguard apparatus according to claim 16 wherein at least one of said lock members is releasably connected to a connector member.

* * * * *